US007137321B1

(12) United States Patent
Huang

(10) Patent No.: US 7,137,321 B1
(45) Date of Patent: Nov. 21, 2006

(54) ADJUSTABLE WRENCH

(76) Inventor: Ping Wen Huang, No. 5, Alley 24, Lane 247, Sinyi St., Wurih Township, Taichung County 414 (TW)

( * ) Notice: Subject to any disclaimer, the term of this patent is extended or adjusted under 35 U.S.C. 154(b) by 0 days.

(21) Appl. No.: 11/445,247

(22) Filed: Jun. 2, 2006

(51) Int. Cl.
*B25B 13/12* (2006.01)

(52) U.S. Cl. ..... 81/126; 81/165; 81/170

(58) Field of Classification Search ..... 81/145, 81/157, 126, 127, 129, 129.5, 165, 170, 173, 81/155, 158
See application file for complete search history.

(56) References Cited

U.S. PATENT DOCUMENTS 6,595,089 B1 * 7/2003 Stojanowski ..... 81/165
6,679,139 B1 * 1/2004 Brenizer ..... 81/165
6,962,099 B1 * 11/2005 Slepekis ..... 81/157

* cited by examiner

*Primary Examiner*—Jacob K. Ackun, Jr.
(74) *Attorney, Agent, or Firm*—Rosenberg, Klein & Lee

(57) ABSTRACT

An adjustable wrench including a fixed jaw, a movable jaw, a handle, a shaft member and a stopper pin. The front end of the handle is pivotally connected with the fixed jaw. When the handle is reciprocally pivotally swung, the stopper pin is driven by the handle to reciprocally move toward the stopper section or away from a stopper section of the shaft member. Also, by means of the spring fitted on the shaft member disposed in the main passage of the fixed jaw, after the movable jaw is slightly opened, the movable jaw will be immediately restored to hold the bolt or nut. Therefore, the bolt or nut can be continuously wrenched at one time without troublesome operation. The adjustable wrench has fewer components which are easier to process and assemble.

7 Claims, 5 Drawing Sheets

ADJUSTABLE WRENCH

BACKGROUND OF THE INVENTION

The present invention is related to an improved adjustable wrench which enables a user to continuously conveniently wrench a polygonal bolt head or nut at one time without troublesome operation.

An adjustable wrench is generally used to wrench a nut or a bolt with a polygonal head section. A user often needs to repeatedly fit the wrench onto the bolt to wrench the same and then unfit the wrench from the bolt and then refit the wrench onto the bolt to further wrench the bolt until the bolt is tightened. Such procedure is quite troublesome. An improved adjustable wrench has been developed to overcome the above problem. The handle of the improved adjustable wrench can be conveniently reciprocally swung as a ratchet wrench to quickly tighten or untighten a bolt or a nut.

FIG. 4 shows a conventional adjustable wrench. The front end of the handle 8 of the wrench is forked to have two diverging sheets 81 spaced from each other by a gap 82. A sector section 831 of a fixed jaw 83 is pivotally disposed in the gap 82 via a pivot shaft 84. A fulcrum is defined between the front end of the handle 8 and the fixed jaw 83. An abutting pin 85 is arranged at the two sheets 81. By means of adjusting the position of the abutting pin 85, the fixed jaw 83 can be resiliently stretched or retracted about the fulcrum within the gap 82. Accordingly, when using the wrench, it is no more necessary for a user to repeatedly fit the wrench onto the polygonal head 9 of the bolt and unfit the wrench from the polygonal head 9. Instead, the user can reversely swing the handle 8 to instantaneously expand the clamping area 861 between the fixed jaw 83 and the movable jaw 86. Therefore, the wrench can be continuously operated to conveniently wrench the polygonal head 9 of the bolt. In addition, when the user desires to discharge the adjustable wrench from the one-way wrenching function as the ratchet wrench, the user only needs to move the abutting pin 85 to its home position to fix the fixed jaw 83 with the handle 8. Under such circumstance, the adjustable wrench can be operated in the original mode.

However, in order to achieve both the traditional function and the ratchet wrench-type function, the above adjustable wrench has numerous complicated components. For example, each of the two sheets 81 is formed with a slide slot 811. A wall of one of the slide slots 811 is further formed with cavity 812 in which a spring 813 and a ball member 814 are accommodated. A restricting block 832 protrudes from the arced edge of the sector section 831 of the fixed jaw 82. In addition, the sector section 831 is formed with a guide slot 833 along the arced edge. A stopper pin 834 is positioned in the guide slot 833 and inserted through the two sheets 81. A resilient member 835 is also positioned in the guide slot 833, whereby by means of the stopper pin 834 and the resilient member 835, the fixed jaw 83 can be reciprocally moved in an arced path. It is troublesome to assemble all these components of the wrench. Also, it is hard to manufacture these components. Moreover, in the case of damage of any of these components, the entire wrench will become useless.

SUMMARY OF THE INVENTION

It is therefore a primary object of the present invention to provide an improved adjustable wrench in which the front end of the handle is pivotally connected with the fixed jaw. When the handle is reciprocally pivotally swung, a stopper pin is driven by the handle to reciprocally move toward the stopper section or away from a stopper section of a shaft member. Also, by means of the spring fitted on the shaft member disposed in the main passage of the fixed jaw, after the movable jaw is slightly opened, the movable jaw will be immediately restored to hold the bolt or nut. Therefore, the bolt or nut can be continuously wrenched at one time without troublesome operation. The adjustable wrench has fewer components which are easier to process and assemble.

According to the above object, the adjustable wrench of the present invention includes:

a fixed jaw having a front side which is a fixed block, the fixed block being formed with a main passage and a tunnel communicating with each other, the tunnel further communicating with a radial duct;

a movable jaw guidable by the fixed jaw and transversely movable relative to the fixed block of the fixed jaw, an adjustable clamping area being defined between the movable jaw and the fixed block of the fixed jaw, a bottom side of the movable jaw being formed with a rack;

a shaft member having a first end section and a second end section opposite to the first end section, a stopper section being defined between the second end section and a middle section of the shaft member, the middle section being fitted in the main passage of the fixed jaw, the second end section and the stopper section being fitted in the tunnel of the fixed jaw with the stopper section aligned with the duct, a spiraled wheel being disposed around the middle section and engaged with the rack of the movable jaw, a spring being fitted on the shaft member between the spiraled wheel and the second end section, two ends of the spring respectively abutting against the spiraled wheel and a wall of the main passage;

a handle having a front end pivotally connected with the fixed jaw, a first side of the front end of the handle being formed with a cavity in which a resilient member is accommodated, one end of the resilient member pushing a bottom end of the fixed block; and a stopper pin slidably disposed in the duct of the fixed block and drivable by the handle, whereby a first end of the stopper pin can selectively extend to the stopper section of the shaft member to stop the stopper section.

The present invention can be best understood through the following description and accompanying drawings wherein:

DETAILED DESCRIPTION OF THE PREFERRED EMBODIMENTS

Figure 1:
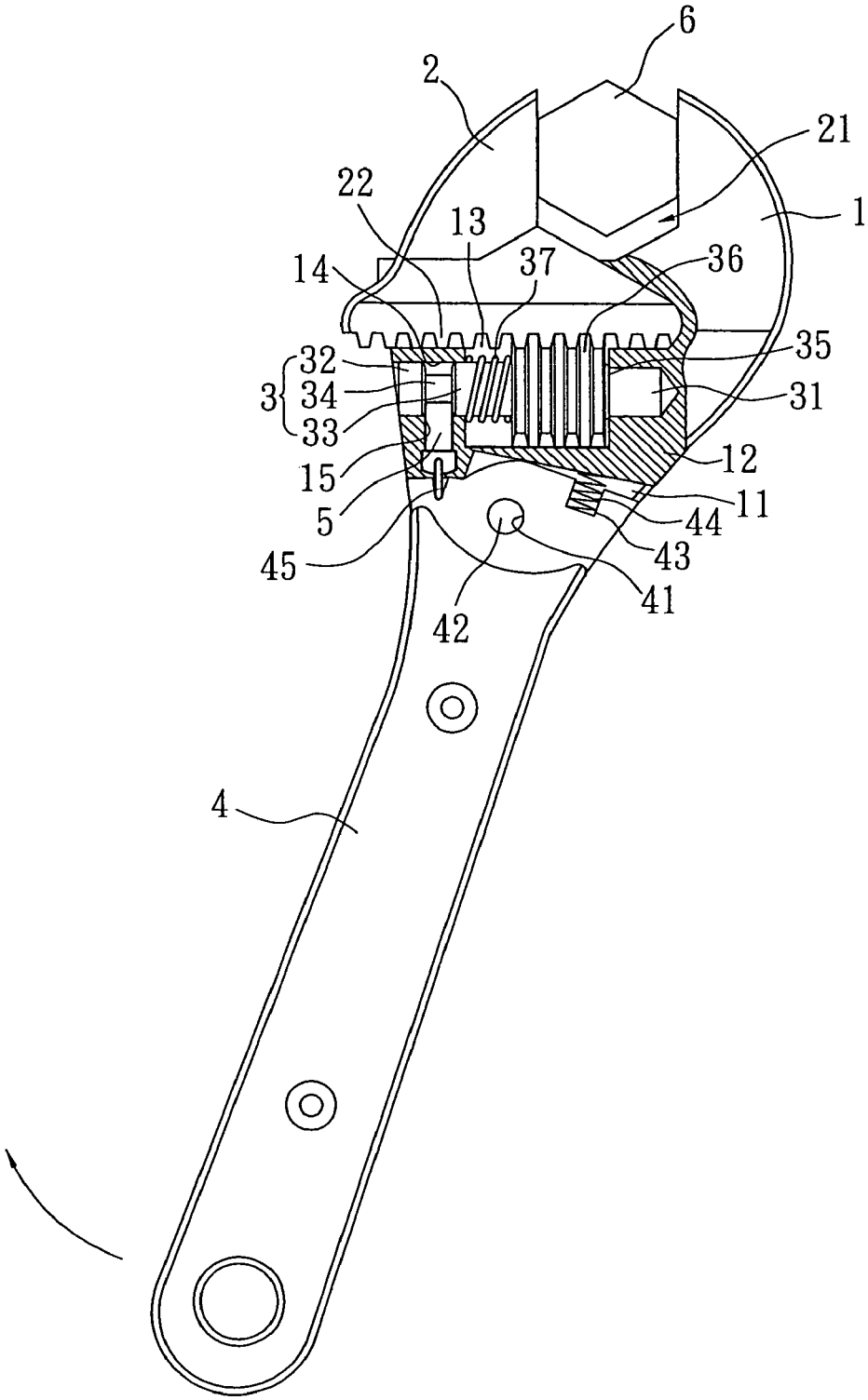
FIG. 1 is a partially sectional view of the adjustable wrench of the present invention, showing that the handle of the adjustable wrench is forward swung and the bolt is held in the clamping area between the fixed jaw and movable jaw.
Figure 2:
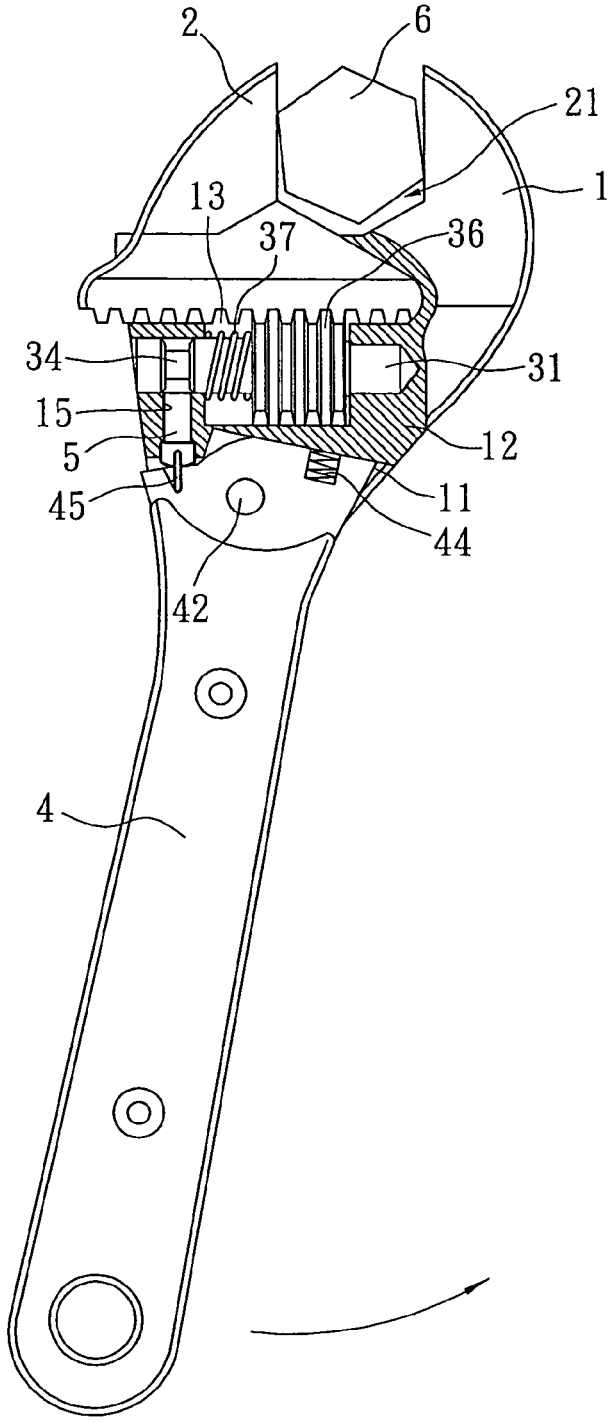
FIG. 2 is a partially sectional view according to FIG. 1, showing that the handle of the adjustable wrench is reversely swung and the clamping area is slightly widened.
Figure 3:
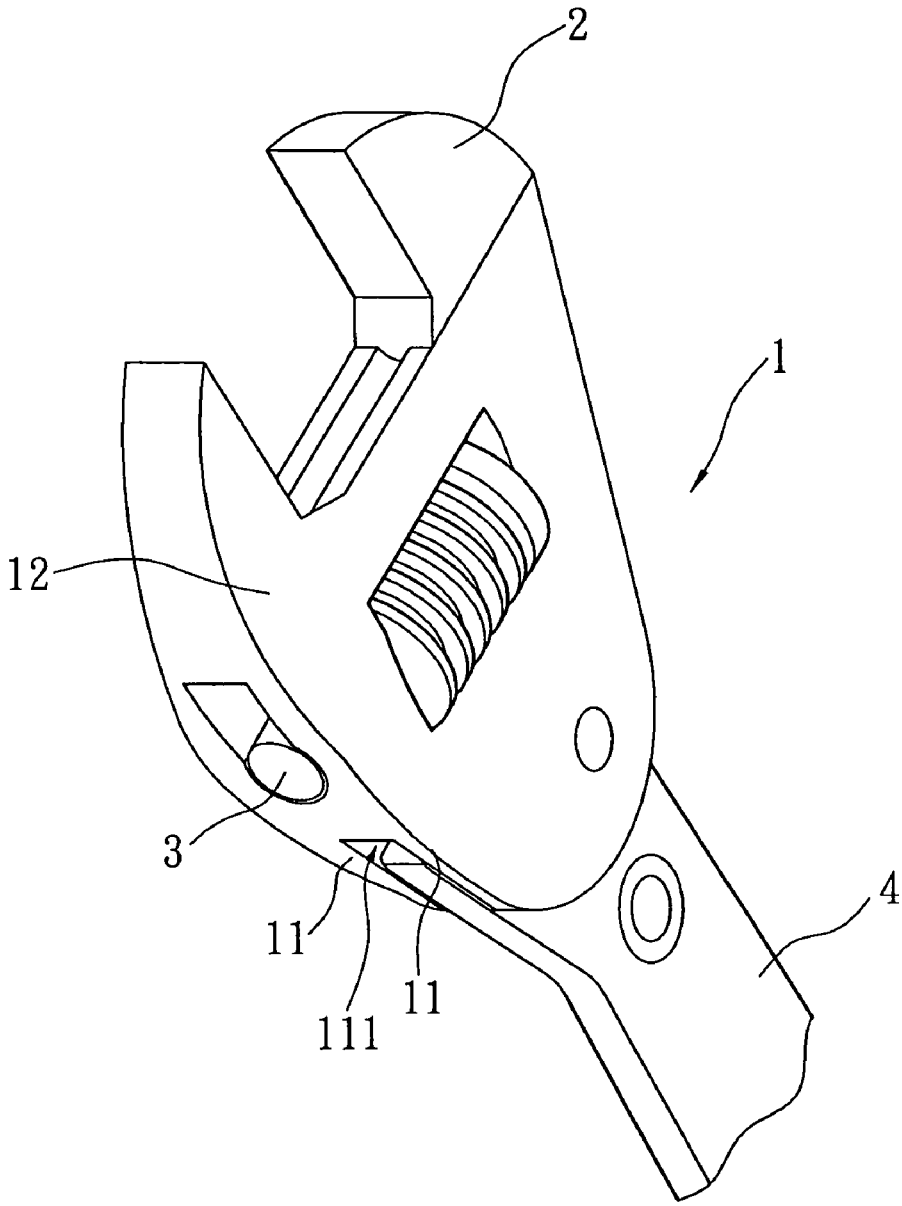
FIG. 3 is a perspective view of the fixed jaw and movable jaw of the adjustable wrench of the present invention.
Figure 4:
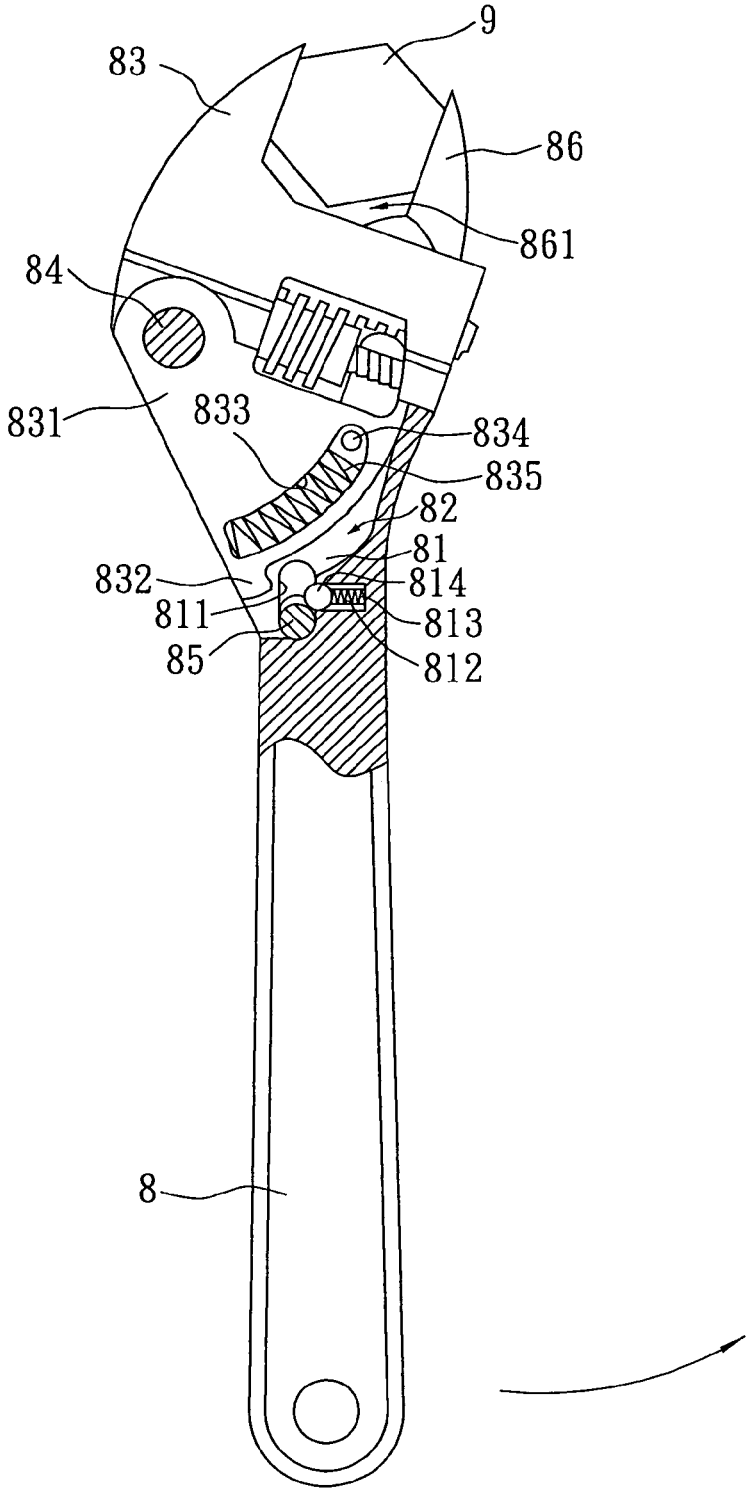
FIG. 4 PRIOR ART
FIG. 4 is a partially sectional view of a conventional adjustable wrench, in which the abutting pin is pushed backward.
Figure 5:
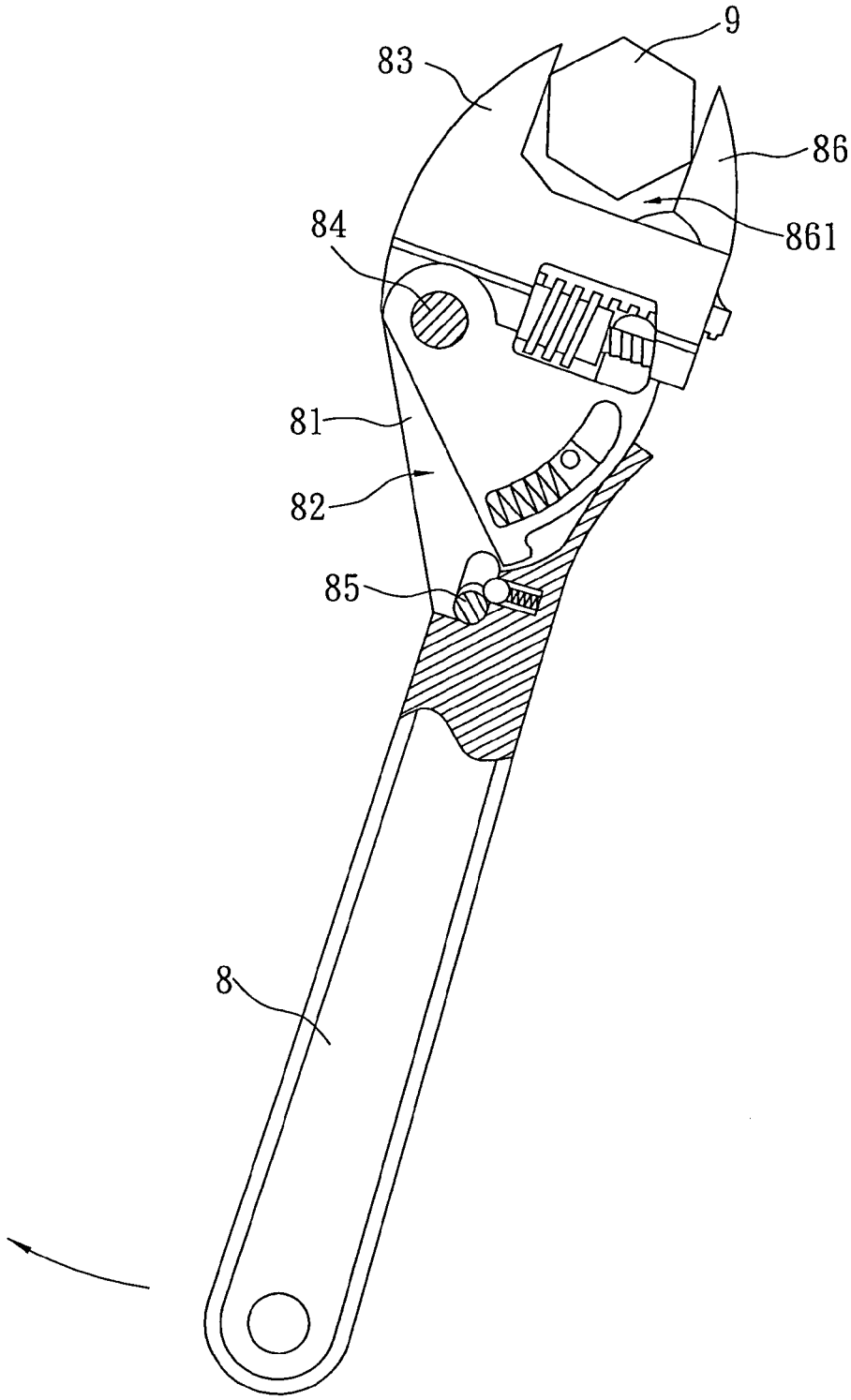
FIG. 5 PRIOR ART
FIG. 5 is a partially sectional view of the conventional adjustable wrench, showing that the handle of the wrench is swung in reverse direction to widen the clamping area.

Please refer to FIGS. 1 to 3. The adjustable wrench of the present invention includes a fixed jaw 1 having a bottom end composed of two sector-shaped sheets 11. The two sector-shaped sheets 11 define therebetween a gap 111. A front side of the fixed jaw 1 is a fixed block 12. The fixed block 12 is formed with a main passage 13 and a tunnel 14 near the gap 111. The main passage 13 and the tunnel 14 communicate with each other. The tunnel 14 further communicates with a radial duct 15 communicating with the gap 111 between the two sector-shaped sheets 11.

The adjustable wrench of the present invention further includes a movable jaw 2 guidable by the fixed jaw 1 and transversely movable relative to the fixed block 12 of the fixed jaw 1. An adjustable clamping area 21 is defined between the movable jaw 2 and the fixed block 12 of the fixed jaw 1. A bottom side of the movable jaw 2 is formed with a rack 22.

The adjustable wrench of the present invention further includes a shaft member 3 having a first end section 31 and a second end section 32 opposite to the first end section 31. A stopper section 34 is defined between the second end section 32 and a middle section 33 of the shaft member 3. The middle section 33 is fitted in the main passage 13 of the fixed jaw 1. The second end section 32 and the stopper section 34 are fitted in the tunnel 14 of the fixed jaw 1 with the stopper section 34 aligned with the duct 15. A spiraled wheel 36 is disposed around the middle section 33 and engaged with the rack 22 of the movable jaw 2. A retainer ring 35 is fitted on the shaft member 3 between the first end section 31 and the spiraled wheel 36. A spring 37 is fitted on the shaft member 3 between the spiraled wheel 36 and the second end section 32. Two ends of the spring 37 respectively abut against the spiraled wheel 36 and a wall of the main passage 13. When the spiraled wheel 36 is rotated, the movable jaw 2 can be driven and transversely moved to adjust the width of the clamping area 21.

The adjustable wrench of the present invention further includes a handle 4 having a front end formed with a shaft hole 41. The front end of the handle 4 is sandwiched between the two sector-shaped sheets 11 of the fixed jaw 1. A pivot shaft 42 is inserted through the shaft hole 41 to pivotally connect the fixed jaw 1 with the front end of the handle 4. Accordingly, the fixed jaw 1 can be pivoted about the pivot shaft 42 to stretch or contract in an arced path. A first side of the front end of the handle 4 in the gap 111 is formed with a cavity 43 in which a resilient member 44 is accommodated. In this embodiment, the resilient member 44 is a spring. One end of the resilient member 44 pushes a bottom end of the fixed block 12. A first leg of a retainer ring 45 is inlaid in a second side of the front end of the handle 4 opposite to the cavity 43.

The adjustable wrench of the present invention further includes a stopper pin 5 slidably disposed in the duct 15 of the fixed block 12. A second leg of the retainer ring 45 is inlaid in a second end of the stopper pin 5. A first end of the stopper pin 5 can selectively extend to the stopper section 34 of the shaft member 3. When the fixed jaw 1 and the front end of the handle 4 are pivotally rotated relative to each other, the front end of the handle 4 can drive the stopper pin 5 to slide, whereby the first end of the stopper pin 5 can selectively stop the stopper section 34 of the shaft member 3.

Referring to FIG. 1, when wrenching a bolt 6 with a polygonal head, a user can first preliminarily slightly lock the bolt 6. The spiraled wheel 36 is rotated to adjust the width of the clamping area 21 for holding the bolt 6. At this time, the stopper pin 5 of the front end of the handle 4 stops the stopper section 34 of the shaft member 3 of the fixed jaw 1. Also, the bottom end of the fixed block 12 of the fixed jaw 1 is pushed by the end of the resilient member 44. Under such circumstance, the movable jaw 2 is unmovable by external force and the width of the clamping area 21 is kept unchanged. As shown in FIG. 2, user can then continuously wrench the bolt 6. When the handle 4 is pivotally swung about the pivot shaft 42 in a reverse direction, the resilient member 44 is compressed and the stopper pin 5 is driven to move away from the stopper section 34 of the shaft member 3. At this time, the shaft member 3 is no more stopped. Also, the front side of the movable jaw 2 is pushed by the obtuse angle of the bolt 6 so that the clamping area 21 is slightly widened. The movable jaw 2 is engaged with the spiraled wheel 36 so that the movable jaw 2 and the spiraled wheel 36 will be together pushed outward. At this time, the spring 37 in the main passage 13 will be compressed by the spiraled wheel 36. Under such circumstance, the user can easily swing the handle 4 in reverse direction. Referring to FIG. 1, when the user wrenches the handle 4 in forward direction, the resilient member 44 restores to its home position. Also, the front end of the handle 4 drives the stopper pin 5 to move back to the stopper section 34 of the shaft member 3. In addition, the spring 37 restores to its original state to push the spiraled wheel 36 back to its home position. The spiraled wheel 36 also drives the movable jaw 2 to move toward the bolt 6 and narrow the clamping area 21 for holding the bolt 6. Therefore, the movable jaw 2 instantaneously moves to attach to the next plane side of the bolt 6. The user can repeat such continuous operation to quickly and easily wrench the bolt 6.

According to the above arrangement, when the handle 4 is reciprocally pivotally swung, the stopper pin 5 is driven by the handle 4 to reciprocally move toward the stopper section 34 or away from the stopper section 34. Also, by means of the spring 37 fitted on the shaft member 3, after the movable jaw 2 is slightly opened, the movable jaw 2 will be immediately restored to hold the bolt 6. Therefore, the bolt 6 can be continuously wrenched at one time without troublesome operation. Moreover, the adjustable wrench of the present invention has fewer components which are easier to process and assemble. Therefore, the manufacturing cost is lower.

The above embodiments are only used to illustrate the present invention, not intended to limit the scope thereof. Many modifications of the above embodiments can be made without departing from the spirit of the present invention.

What is claimed is:

1. An adjustable wrench comprising:

a fixed jaw having a front side which is a fixed block, the fixed block being formed with a main passage and a tunnel communicating with each other, the tunnel further communicating with a radial duct;

a movable jaw guidable by the fixed jaw and transversely movable relative to the fixed block of the fixed jaw, an adjustable clamping area being defined between the movable jaw and the fixed block of the fixed jaw, a bottom side of the movable jaw being formed with a rack;

a shaft member having a first end section and a second end section opposite to the first end section, a stopper section being defined between the second end section and a middle section of the shaft member, the middle section being fitted in the main passage of the fixed jaw, the second end section and the stopper section being fitted in the tunnel of the fixed jaw with the stopper section aligned with the duct, a spiraled wheel being disposed around the middle section and engaged with the rack of the movable jaw, a spring being fitted on the shaft member between the spiraled wheel and the second end section, two ends of the spring respectively abutting against the spiraled wheel and a wall of the main passage;

a handle having a front end pivotally connected with the fixed jaw, a first side of the front end of the handle being formed with a cavity in which a resilient member is accommodated, one end of the resilient member pushing a bottom end of the fixed block; and a stopper pin slidably disposed in the duct of the fixed block and drivable by the handle, whereby a first end of the stopper pin can selectively extend to the stopper section of the shaft member to stop the stopper section.

2. The adjustable wrench as claimed in claim 1, wherein the fixed jaw has a bottom end composed of two sector-shaped sheets, the two sector-shaped sheets defining therebetween a gap.

3. The adjustable wrench as claimed in claim 2, wherein the main passage and the tunnel are formed in the fixed block near the gap.

4. The adjustable wrench as claimed in claim 1, wherein a retainer ring is fitted on the shaft member between the first end section and the spiraled wheel.

5. The adjustable wrench as claimed in claim 1, wherein the spiraled wheel is located in the main passage by means of the retainer ring and the spring respectively disposed on two sides of the spiraled wheel, whereby when the spiraled wheel is rotated, the movable jaw is driven and transversely moved to adjust the width of the clamping area.

6. The adjustable wrench as claimed in claim 1 or 2, wherein the front end of the handle is formed with a shaft hole, the front end of the handle being sandwiched between the two sector-shaped sheets of the fixed jaw, a pivot shaft being inserted through the shaft hole to pivotally connect the fixed jaw with the front end of the handle, whereby the fixed jaw can be pivoted about the pivot shaft to stretch or contract in an arced path.

7. The adjustable wrench as claimed in claim 1, wherein a first leg of a retainer ring is inlaid in a second side of the front end of the handle opposite to the cavity, a second leg of the retainer ring being inlaid in a second end of the stopper pin, whereby when the fixed jaw and the front end of the handle are pivotally rotated relative to each other, the front end of the handle drives the stopper pin to slide, making the first end of the stopper pin selectively stop the stopper section of the shaft member.

* * * * *